US005534906A

United States Patent [19]

Yamada et al.

[11] Patent Number: 5,534,906

[45] Date of Patent: Jul. 9, 1996

[54] ELECTRIC FIELD ASSISTED THERMAL RECORDING APPARATUS

[75] Inventors: Keiki Yamada; Masaru Ohnishi; Yoshiaki Odai; Ryoji Arima, all of Kamakura, Japan

[73] Assignee: Mitsubishi Denki Kabushiki Kaisha, Tokyo, Japan

[21] Appl. No.: 929,301

[22] Filed: Aug. 13, 1992

[30] Foreign Application Priority Data

| | | | |
|---|---|---|---|
| Aug. 21, 1991 | [JP] | Japan | 3-209280 |
| Feb. 13, 1992 | [JP] | Japan | 4-026974 |

[51] Int. Cl.[6] ..... B41J 2/325

[52] U.S. Cl. ..... 347/171; 347/199

[58] Field of Search ..... 346/76 PH, 76 L; 400/120, 118.3; 347/199

[56] References Cited

U.S. PATENT DOCUMENTS

| | | | |
|---|---|---|---|
| 4,772,582 | 9/1988 | DeBoer | 503/227 |
| 5,045,865 | 9/1991 | Crystal et al. | 346/76 PH |
| 5,122,882 | 6/1992 | Ishida et al. | 346/76 PH |
| 5,172,131 | 12/1992 | Crystal et al. | 346/1.1 |
| 5,198,835 | 3/1993 | Ando et al. | 346/76 PH |
| 5,262,800 | 11/1993 | Smith et al. | 347/171 |

FOREIGN PATENT DOCUMENTS

| | | |
|---|---|---|
| 0427212A3 | 6/1990 | European Pat. Off. . |
| 60-104355 | 6/1985 | Japan . |
| 60-199692 | 10/1985 | Japan . |
| 61-162372 | 7/1986 | Japan . |
| 61-252192 | 11/1986 | Japan . |
| 0067133 | 3/1990 | Japan . |

OTHER PUBLICATIONS

Aviram, "Electrothermic Printing Method and Apparatus Using a Photoconductor and Funible Ink", IBM Technical Bulletin, vol. 20 No. 2, Jul. 1977, pp. 808–809.

IBM Technical Disclosure Bulletin, Jan. 1987 "Resistive Ribbon Printing with Adjacent Electrodes".

"Imaging Part 2" Electronic Photographic Society's Hard Copy Series . . . pp. 65–73.

*Primary Examiner*—Huan H. Tran

*Attorney, Agent, or Firm*—Wolf, Greenfield & Sacks

[57] ABSTRACT

In a thermal recording apparatus, a thermal head heats an ink sheet to transfer ink to a recording medium such as paper. Even when recording on a low-smoothness plain paper, an image free of voids can be obtained. The apparatus is equipped with a mechanism for generating an electric field between the ink sheet and the recording medium. Due to this electric field, the ink particles liquified by the thermal head fly and are transferred to the recording medium.

29 Claims, 10 Drawing Sheets

ELECTRIC FIELD ASSISTED THERMAL RECORDING APPARATUS

BACKGROUND OF THE INVENTION

1. Field of the Invention

This invention relates to a thermal recording apparatus using a thermal head, and more particularly to a thermal recording apparatus which makes it possible to record even on a rough-surfaced paper sheet or to perform half-tone recording.

2. Description of the Related Art

Since it is simple in structure, high in reliability and convenient to maintain, thermal recording and thermal transfer recording are currently the mainstream in facsimile and color printing, respectively.

FIG. 13 of the accompanying drawings shows a typical conventional thermal transfer recording apparatus. This thermal transfer recording apparatus comprises a thermal head 1 having heat generating elements (not shown) for thermal transfer to a recording paper 6, a platen roller 21 against which the thermal head 1 is to be pressed, and an ink sheet 20 having an ink layer in which a plurality of sets of color regions of yellow (Y), magenta (M) and cyan (C), or black (K) if necessary, are arranged in a row. The ink sheet 20 also has a thin base film such as of polyethylene terephthalate (hereinafter abbreviated as "PET") formed over the ink layer. Generally the recording paper 6 is a high-quality paper or a dedicated paper having a high degree of smoothness.

In color recording, firstly the yellow (Y) region of the ink sheet 20 is conveyed into the gap between the thermal head 1 and the platen roller 21 with the recording paper 6. During recording, the heat generating elements of the thermal head 1 are energized for a predetermined time to generate joule heat and then the heat is transferred to the ink sheet 20. As a result, according to a record signal, solid ink on the ink sheet 20 is softened (liquefied) and is then transferred in part to the recording paper 6. The same operation is repeated in order for every color. In monochromatic recording, the same recording is made on the ink sheet 20 whose ink layer consists of only a black (K) region.

The common problem with the conventional thermal transfer recording apparatuses has been only a limited printing speed and the need for smooth-surfaced paper. For a better printing speed, on the one hand, it is now customary to improve the thermal head itself or to control the temperature of the heat generating elements precisely.

On the other hand, studies are currently being made to enable recording on plain paper sheets (PPC paper), which are widely used in copying machines. However, in thermal transfer recording, the process to transfer ink to a paper depends on the roughness of the paper surface; for example, when a rough paper is used, mistransfer such as voids would occur to deteriorate the quality of recording. This results because ink could not adhere to recesses or dents on the paper surface but could be transferred to only other surface portions.

In a serial printer, a fairly good printing can be obtained on a low-smoothness paper such as PPC paper by transferring ink in a bridge form; whereas in a line printer, an adequate result can not be obtained. For example, a publication "IMAGING Part 2" (Electronic Photographic Society's Hard Copy Series edited by the Electronic Photographic Society, pages 65–73) issued by Photographic Industries Publisher Co. Ltd. (a Japanese corporation) discloses: the concept of optimizing the break elongation rate and the viscoelasticity of ink at the ink peeling temperature (improvement to the ink sheet); an edge-type head with which the ink peeling timing is reduced in order to transfer ink while the ink viscosity is low at a high temperature and in which an adequately large angle of peeling ink can be realized (improvement to the ink peeling method); and the concept of bulging the graded layer right under the heat generating elements to cause an intimate contact with the recording paper (improvement to the head structure). In addition, studies are currently being made to apply an increased amount of power to cause ink to flow into recesses on the paper surface.

When recorded on a low-smoothness paper such as bond paper, voids may occur in parts to varying degrees. When applying an increased amount of power to eliminate any voids, ink would bolt on the paper.

The reasons why the edge peeling method could not eliminate the foregoing problems are that the solidifying time of ink was usually several ms and that solidification terminated before recording reached the peeling position in a line printer. Specifically, with the thermal head of 12 dots/mm in which the heat generating elements are located in a position 1 mm from the edge, recording of 1 line must be completed within 5/12 ms. Since the number of heat generating elements per line is about 2500, it requires a power supply of over several kW to meet the foregoing conditions, which is not practical.

Another problem with thermal transfer recording is that half-tone recording could not be achieved; that is, only binary recording, i.e. recorded or not recorded, was possible. Generally thermal transfer recording done using energy immediately after the recording density has become saturated in the relationship between energy and recording density. This is because if transient energy before the recording density becomes saturated was used, the recording density would have varied widely to deteriorate the image quality considerably. This is partly because the probability of whether or not ink is transferred to the paper would be 50% and partly because components constituting as image noise would increase in this operating region. Therefore in half-tone recording, it was inevitable to use pseudo gradation such as area gradation so that resolution becomes impaired.

SUMMARY OF THE INVENTION

It is therefore an object of this invention to provide a thermal recording apparatus with which a high-quality image free of voids can be obtained even when recorded on a low-smoothness paper such as rough paper and with which half-tone gradation can be obtained and which consumes only a reduced amount of ink sheet.

According to a first aspect of the invention, there is provided a thermal recording apparatus comprising: an ink sheet having an electrically conductive or chargeable ink layer; a thermal head for heating the ink sheet; and means for creating an electric field between the ink sheet and a recording medium.

According to a second aspect of the invention, there is provided a thermal recording apparatus comprising: an ink sheet having a conductive or chargeable ink layer and a resistance layer for generating joule heat when energized; a pair of electrodes for applying a current to the resistance layer; and means for creating an electric field between the ink sheet and a recording medium.

According to a third aspect of the invention, there is provided a thermal recording apparatus comprising: an ink sheet having a conductive or chargeable ink layer and a photo-thermal transducing layer for generating heat upon receipt of an electromagnetic wave; means for applying an electromagnetic wave to the photo-thermal transducing layer; and means for creating an electric field over the ink sheet and a recording medium.

To obtain a better quality recording, electric field generating means may create an electric field obtained by superposing an a.c. voltage over a d.c. voltage.

To reduce an amount of ink sheet to be consumed, the ink sheet feed speed may be smaller than the recording medium feed speed, and the heat generators of the thermal head may have a length, in the direction of conveying the recording medium.

Means generating an electric field is provided according to a number of use of the sheet, by using the ink sheet repeatedly, and storing or recording the number of use onto the ink sheet, and reading on the data.

An ink material permeated in the ink sheet may be a conductive material to form an ink layer serving as an electrode at one end of the electric field impressing means.

To prevent any leak, the chargeable layer of the ink sheet may be formed of an ink holding material which is insulative at room temperature and conductive when heated.

The thermal recording apparatus may further comprise means for retaining a gap between the ink sheet and the recording medium.

The conductive layer of the ink sheet may have an area larger than that of the remaining layers and serves to make and contact with the electrode.

In operation, an electric field is generated between the recording medium and the ink sheet, which has the conductive or chargeable ink layer, by the electric field generating means. Since due to this electric field the ink which has been softened by the heating means such as the thermal head is conveyed toward the recording medium so as to be transferred thereto, high-quality recording free of voids can be achieved.

Particularly in the case where the electric field is provided by superposing an a.c. voltage over a d.c. voltage, since ink particles which are vibrating are made to reach the recording medium, the scattered recording densities are averaged based on the fact that ink particles reach the recording medium in different time periods depending on their size, thus resulting in high-quality recording and good half-tone graded recording.

Further, since the thermal head presses against the ink sheet and the recording medium with a small amount of force, it is possible to make the ink sheet feed speed smaller than the recording paper feed speed so that the amount of ink sheet to be consumed can be reduced. Inksheet consumption can also be reduced by using the inksheets repeatedly.

Since the heat generating elements of the thermal head can be reduced in size, the thermal head itself can also be reduced in size.

By using, as an ingredient, an inorganic dye obtained from a dyed white conductive material, it is possible to realize color printing.

Since the ink material permeated in the ink sheet is conductive, it is not necessary to add to the ink sheet a conductive layer such as a metal layer, thus making the ink sheet inexpensive.

By using, as an ink holding material, a material which is insulative at room temperature and conductive when heated, it is possible to prevent any leakage from occurring.

Since ink is made to transfer stably by the gap retaining means, it is possible to control the printing density precisely.

Further, partly since the area of the conductive layer of the ink sheet is larger than that of the remaining layers, and partly since this expanded layer serves as a contact with the electrode through which the voltage for generating an electric field is to be impressed, it is possible to obtain a stable electric field.

DETAILED DESCRIPTION

Figure 1:
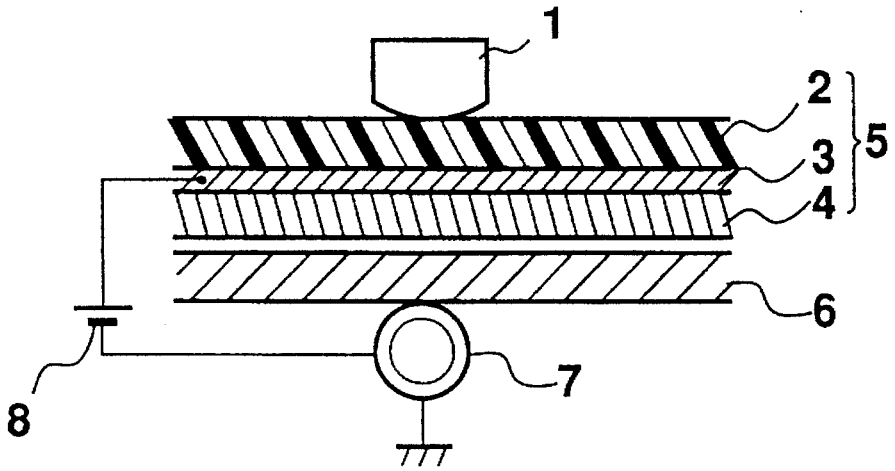
FIGS. 1(A) and 1(B) are schematic cross-sectional views each showing the main portion of a thermal recording apparatus according to one embodiment of this invention.
Figure 1:
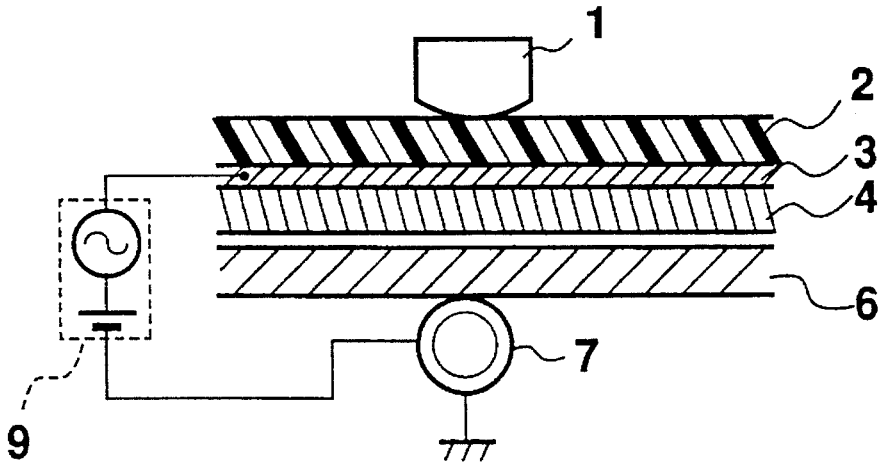

Various embodiments of this invention will now be described with reference to the accompanying drawings. FIGS. 1(A) and 1(B) are schematic cross-sectional views each showing the main portion of a thermal recording apparatus according to this embodiment; like reference numerals designate similar or corresponding parts or portions throughout FIGS. 1(A) and 1(B). The only difference between FIGS. 1(A) and 1(B) is that one uses only a d.c. bias voltage while the other uses both a.c. and d.c. bias voltages.

In FIG. 1(A), reference numeral 1 designates a thermal head in which, for example, 2500 non-illustrated heat generating elements are arranged perpendicularly to the plane of this drawing sheet. 5 designates an ink sheet composed of a PET film (Mylar film), a metal layer 3 such as of aluminum, and an electrically conductive ink layer 4. 6 designates a recording paper such as low-smoothness paper, e.g. bond paper. Between the ink sheet 5 and the recording paper 6, there exists an air layer 10. Some air will also remain between the thermal head 1 and the ink sheets. 7 designates a platen roller which is composed of a central metal portion and an outer conductive rubber and which is rotatable anticlockwise, while pressing the recording sheet 6 toward the ink sheet 5 between the thermal head 1 and the platen roller 7, the central metal portion being grounded. 8 designates a d.c. voltage source for impressing a voltage between the metal portion of the platen roller 7 and the metal layer 3 of the ink sheet to create an electric field. The platen roller 7 and the D.C. voltage source 8 jointly constitute an electric field impressing means.

9 in FIG. 1(B) designates a voltage source for impressing a bias voltage obtained by superposing a d.c. voltage and an a.c. voltage over each other.

EMBODIMENT 1

The operation of this thermal recording apparatus will now be described with reference to FIG. 1(A). A bias voltage is impressed between the ink sheet 5 and the platen roller 7 to create an electric field between the ink sheet 5 and the recording sheet 6.

The conductive ink layer 4 may be liquefied in the same manner as the conventional thermal transfer recording method. Specifically, the thermal head 1 is driven by a signal from a non-illustrated thermal head control circuit to energize the heat generating elements of the thermal head 1 to generate joule heat is to be transmitted to the ink sheet 5. This joule heat is transmitted to the PET film 2, then the metal layer 3 and finally to the conductive ink layer 4 so that the conductive ink layer 4 will become liquefied.

The conductive ink layer 4 is composed of carbon or metal such as silver, wax and dye, and preferably has a conductivity of about $10^3$ to $10^8$ Ωcm as proved by experiments. Alternatively the conductive ink layer 4 may be composed of dye such as carbon, and a conductive processed material or a conductive resin binder.

The conductive ink layer is selectively liquefied by transferred joule heat so that the ink particles of the conductive ink layer 4 will fly (downwardly in FIG. 1(A)) due to gravitation and the electric field caused by the bias voltage, so as to adhere to the recording paper 6.

With the thermal recording apparatus, since the ink particles fly and adhere to the recording paper 6, recording can be done in a constant condition, irrespective of the kind of the recording paper 6.

Generally, in thermal transfer recording, the rough-paper recording characteristic would be poor because the ink is liquefied by joule heat when adhering to the paper. In ink jet recording, although recording is possible on rough paper, ink would be bolted on the paper, and the ink nozzle would get clogged and hence there are difficulties with maintenance. This invention can eliminate these problems.

EMBODIMENT 2

The thermal recording apparatus of FIG. 1(B) is similar to that of FIG. 1(A) except that an a.c. voltage is added as a bias voltage. If only a d.c. voltage is impressed like the case of FIG. 1(A), the same result as the previous embodiment can be obtained; if an a.c. voltage in addition to a d.c. voltage is impressed, higher-quality recording and excellent half-tone recording can be realized, compared to the embodiment of FIG. 1(A).

This embodiment will now be described from a view point of half-tone recording. In general, the liquefied ink particles in the conductive ink layer 4 are not constant in either size or weight. Therefore even when an electric field is created between the ink sheet 5 and the recording paper 6, ink particles often do not fly constantly so that the recording density on the surface of the recording paper 6 tends to be not constant. This is due to the difference in charge between ink particles; in kinetic recording like recording using the thermal head 1, the difference in flying time period between ink particles of different sizes will cause the recording density to vary widely. Addition of an a.c. voltage will assist in eliminating this unevenness of the recording density.

The result when an a.c. voltage is added will now be described. When an a.c. voltage is superimposed over a bias d.c. voltage, the ink particles adhere as they move up and down. Namely, when the a.c. voltage is impressed in the same direction as the d.c. voltage, the ink particles move toward the recording paper 6; when the a.c. voltage is impressed in the direction opposite to the d.c. voltage, the ink particles move toward the ink sheet 5. During that time, the smaller the ink particles, the more violently they move up and down. Since the amount of movement of ink particles from the conductive ink layer 4 is relatively the same, the ink particles arrive at the recording paper 6 substantially at the same time.

Thus, half-tone recording can be realized by controlling both joule heat due to the thermal head 1, which causes the conductive ink layer 4 to melt, and the bias voltage. If with the bias voltage set to an optimum value, joule heat and thus the impressed voltage of the thermal head is varied, excellent half-tone recording can be achieved. The a.c. voltage should by no means be limited to a sine wave or a rectangular wave. Preferably the frequency should be within the range of 40 Hz to 200 kHz. If the frequency is less than 40 Hz, the recording speed would have to be made slow to obtain the required quality; if the frequency is over 200 kHZ, the range of movement of ink particles is smaller so that it negates the effects gained by the addition of the a.c. voltage.

EMBODIMENT 3

In the thermal recording apparatus of FIG. 1(A), to the ink sheet 5 composed of a conductive ink layer 4, whose resistance is $10^6$ Ωcm and melting point is 70° C., and a PET film 2 of 4.5 μm and a metal layer 3 (e.g., aluminum layer) of 1000 Angstrom, a d.c. bias voltage was impressed to energize the heat generating elements of the thermal head 1 and to thus melt the conductive ink layer 4. As the d.c. bias voltage was increased, the amount of ink adhered to the recording sheet 6 was increased and saturated at about 300 V. Upon the impression of a 300 V bias voltage, high-quality recording free of voids was achieved.

EMBODIMENT 4

In the thermal recording apparatus of FIG. 1(A), the platen roller 7 is grounded. Whereas in this case, a bias voltage of 300 V was impressed between the ink sheet 5, which was grounded, and the platen roller 7, and a high-quality image was obtained.

EMBODIMENT 5

In addition to the same conditions as Embodiment 3, an a.c. voltage of 100 V was superimposed over the d.c. bias voltage. Also in this case, perfect recording with no voids was achieved as ink particles flew. Even in the case where bond paper, Japanese paper, an OHP film, thermal transfer recording paper (high-quality paper) and copying paper were used as the recording paper 6, good recording was achieved. By varying the heating time of the thermal head 1 from 300 ns to 1.0 ms, 32 level gradation recording was realized.

EMBODIMENT 6

Figure 2:
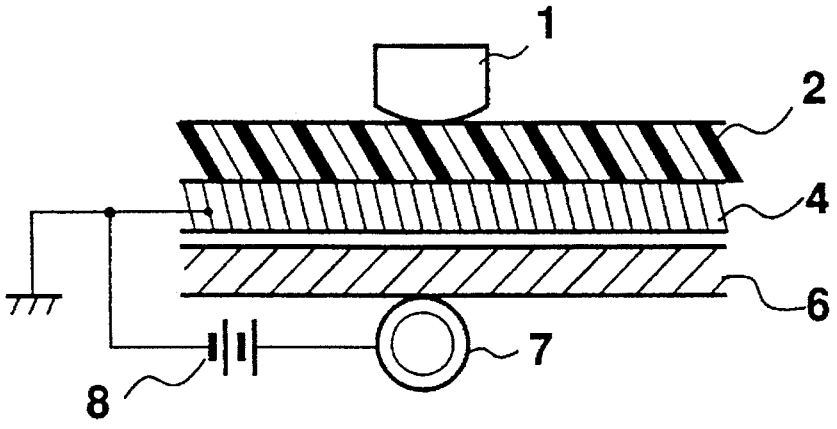
FIG. 2 is a schematic cross-sectional view showing the main portion of a modified thermal recording apparatus according to another embodiment of the invention.

As shown in FIG. 2, the ink sheet 5 was composed of a PET film 2 and a conductive ink layer 4. A bias voltage of 450 V was impressed between the conductive ink layer 4 and the platen roller 7. Also in this case, an image of the recording density 1.3 with no void was obtained.

In the foregoing embodiments, the line-type thermal head was used. Also in the case of a serial-type thermal head, the same result can be obtained.

In the ink sheet 5, when using either monochromatic (K) or color (Y, M, C), the same result was obtained. In color recording, colors are superimposed over one another usually in the order of Y, M and C. The recording of M and C may be made on the ink or on the recording paper 6; high-quality recording could not be achieved because ink is transferred with varying easiness. This is because the condition of the surface over which the next ink is superposed becomes uneven as inks are superimposed successively. In other words, the ink adheres to the paper surface or the previous ink surface, depending on the color of recording; or the ink is transferred to the valley-shape portions or flat portions where adjacent image elements are already recorded, depending on the pattern of recording. Practically, if the same energy is impressed, the same recording density cannot be obtained. The order to obtain better transfer efficiency is the flat ink surface, the flat paper surface, the valley-shape ink surface and the valley-shape paper surface; in the conventional apparatus, to realize good recording, control must be done in view of the recording pattern or the recording condition, which would have resulted in an expensive apparatus. Whereas in this invention, the foregoing problems can be overcome, and no external circuit is required and hence it is possible to reduce the cost of production. Further since ink flies, good recording can be achieved irrespective of the condition of the surface to which ink is to be transferred.

In this invention, with the structure of FIGS. 1(A), 1(B) and 2, color recording can be realized using the ink sheet 5 composed of yellow (Y), magenta (M) and cyan (C) layers, plus a black (Bk) layer if necessary. Also in the case of a color ink sheet, the ink sheet 5 has a conductive ink layer 4. In particular color recording, the conductive material is preferably transparent. For example, as the ink material, a white conductive dye (such as tin oxide, titanium oxide or zinc oxide) dyed by an inorganic dye is used, or a resin material whose resistivity decreases when heated by the binder of the ink material. These materials are exemplified by a conductive material composed of such as polyamid resin, conductive polymer such as soluble polyaniline, fine powdery metal filler, a transparent conductive coating material such as antimony-containing tin oxide or tin-containing indium oxide, and ion conductive resin such as cationic polymer.

EMBODIMENT 7

In each of the foregoing embodiments, the means for heating the ink layer is the thermal head. The ink layer may be heated by an alternative means as shown in FIG. 3.

Figure 3:
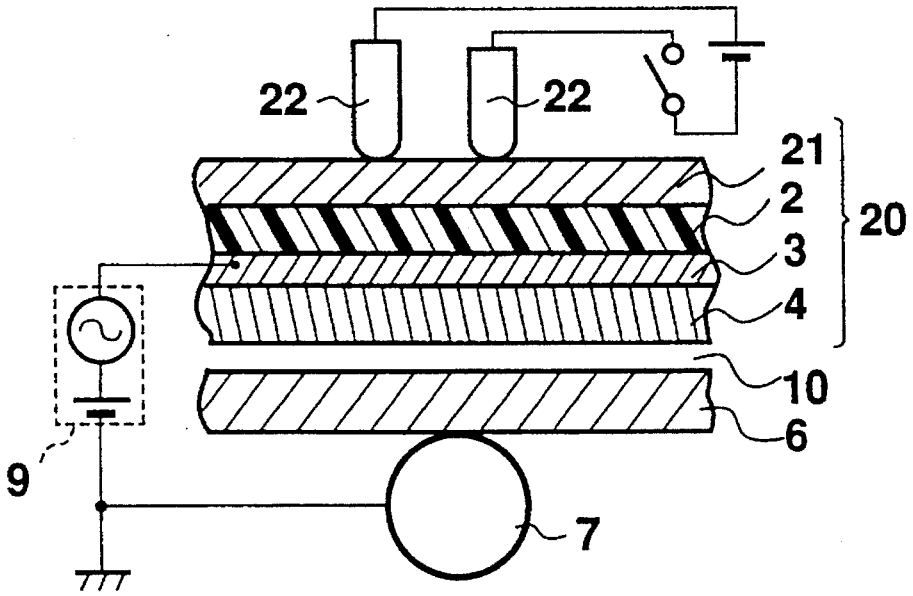
FIG. 3 is a schematic cross-sectional view showing a modified form of heating means according to still another embodiment.

FIG. 3 is similar to the structure of FIGS. 1(A), 1(B) and 2 except that a resistance layer 21 is added to the ink sheet 5 of the previous embodiments to constitute an ink sheet 20. The resistance layer 21 generates joule heat due to a current flowing between a pair of electrodes 22. Due to this joule heat the ink of the conductive ink layer 4 is liquefied, and the liquefied ink particles fly due to an electric field created by the bias voltage so as to adhere to the recording paper. This pair of electrodes 22, 22 corresponds to one of the heat generating elements of the thermal head 1. By providing a plurality of electrode pairs 22 corresponding to the respective heat generating elements of the thermal head 1, the same recording as in the previous embodiments can be achieved.

EMBODIMENT 8

Figure 4:
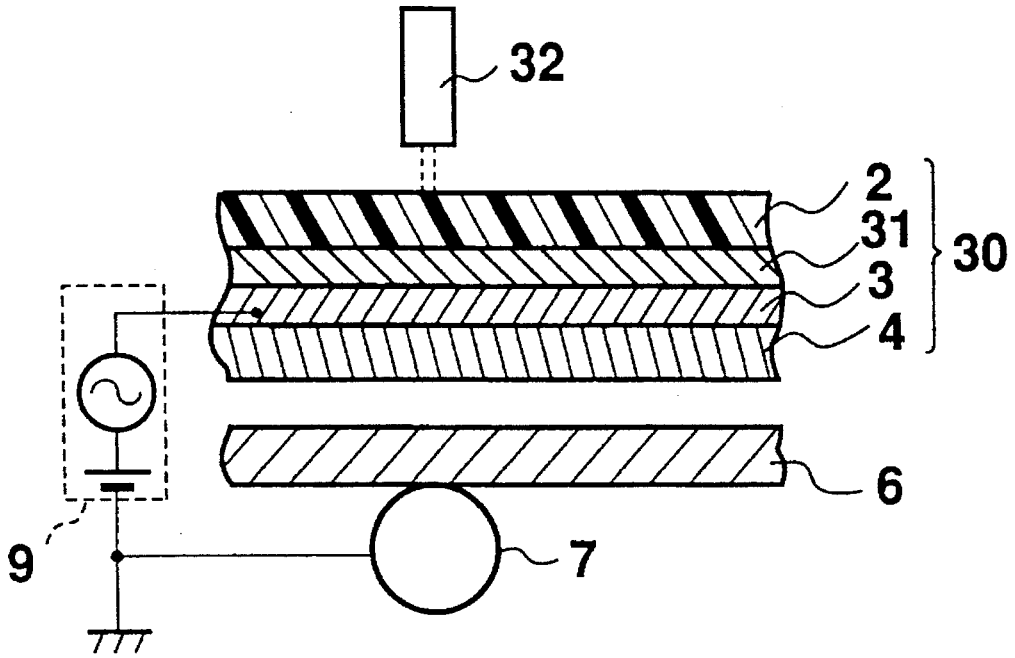
FIG. 4 is a schematic cross-sectional view showing another modified form of heating means according to a further embodiment.

FIG. 4 shows another embodiment in which the ink layer is heated by a heating means other than the thermal head. In this embodiment, parts or elements similar to those of the previous embodiments are designated by like reference numerals, and their description is omitted for clarity. The heating means of this embodiment includes a laser light source 32 and a photo-thermal transducing layer 31 added to an ink sheet 30. Upon receipt of laser light from the laser light source 32, the photo-thermal transducing layer 31 generates heat to heat the ink layer. Then the heated and liquefied ink adheres to the recording paper in the same manner as the previous embodiments. There may be provided a plurality of laser light sources 32 corresponding to the respective heat generating elements of the thermal head 1. Alternatively, laser light from a single laser light source may be refracted or reflected to radiate at a predetermined position on the ink sheet for heating.

In this embodiment, laser light was used to heat the ink sheet. Alternatively heating may be done by electromagnetic waves such as microwaves. More preferably the photo-thermal transducing layer 31 is formed of a material whose transducing efficiency is good in the microwave band.

Furthermore, if carbon is contained in the ink layer, the ink layer serves as both a photo-thermal layer and a metal layer. Thus it is possible to provide a simple ink sheet in a two-layer structure consisting of a PET film layer as the base and an ink layer containing carbon.

EMBODIMENT 9

An embodiment regarding the recording paper feed speed will now be described.

In the thermal recording apparatus of this invention, the liquefied ink particles fly due to the electric field to adhere to the recording paper. Therefore, unlike the conventional apparatus, an air layer 10 may be located between the ink sheet 5 and the recording paper 6, as shown in FIGS. 1(A), 1(B), 2 and 3. It is therefore possible to reduce the amount of pressure with which the recording paper 6 is to be pressed toward the thermal head 1 by the platen roller 7. Since the ink particles are attracted between the ink sheet 5 and the recording paper 6 by the electric field between the ink sheet 5 and the platen roller 7, only a small amount of pressing force of the thermal head 1 is required. Therefore, even when any relative speed between the ink sheet 5 and the recording paper 6 happens to be created, neither the ink sheet 5 nor the recording paper 6 would become broken or creased.

Figure 5:
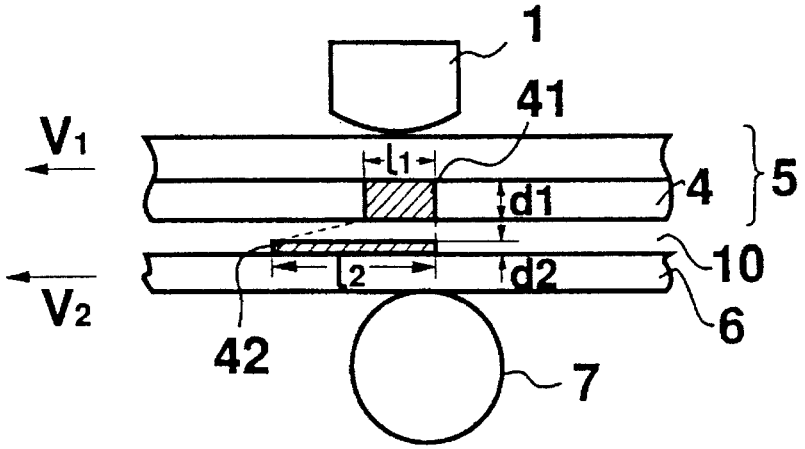
FIG. 5 is a diagram illustrating the relationship between the ink sheet feed speed and the recording paper feed speed.
Figure 6A:
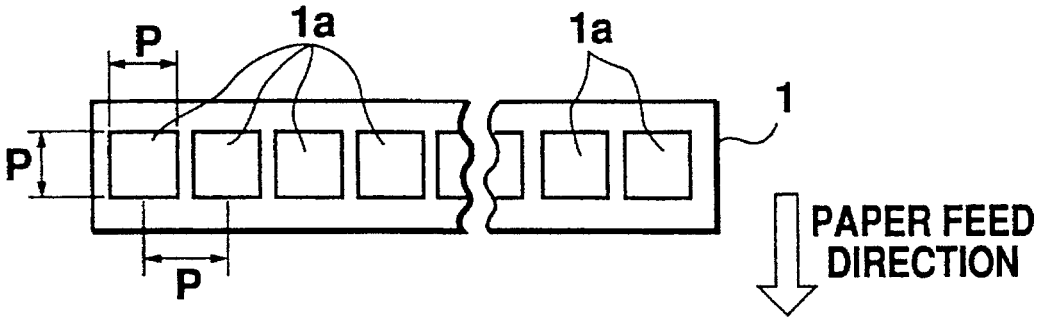
FIGS. 6(A) and 6(B) are diagrams each illustrating a thermal head to be used in the invention.
Figure 6B:
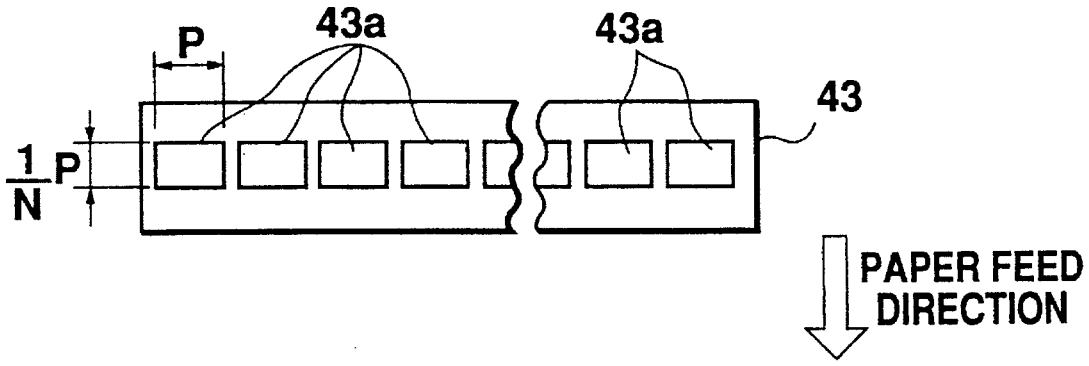

This embodiment utilizes the above-mentioned characteristic and will now be described with reference to FIGS. 5, 6(A) and 6(B). FIG. 5 shows the structure of this embodiment similar to that of FIGS. 1(A), 1(B). Parts or elements similar to those of FIGS. 1(A), 1(B) are designated by like reference numerals and their description is omitted for clarity. The only difference of this embodiment from the embodiment of FIGS. 1(A), 1(B) is that the ink sheet feed speed is different from the recording paper feed speed. In FIG. 5, $v_1$ stands for the ink sheet feed speed and $v_2$ stands for the recording paper feed speed. The speed ratio is N ($=v_2/v_1$).

Since there is a relative speed between the ink sheet 5 and the recording paper 6, the ink (designated by 41) heated by the thermal head 1 is transferred to the recording paper 6 at a portion designated by 42. Therefore, to record the feedwise length ($l_2$) of 1 dot on the recording paper 6, the length on the ink sheet 5 may be $l_1$ ($=l_2 \times 1/N$). This means that the feedwise length of the heat generating elements of the thermal head may be 1/N. This will now be described in connection with FIGS. 6(A) and 6(B). FIG. 6(A) shows the conventional thermal head whose heat generating elements are arranged in a square shape each side of which is substantially equal to the pitch P in a direction perpendicular to the paper feed direction. In this embodiment, the length in the paper feed direction may be P/N, as shown in FIG. 6(B). As a feature, the heat generating elements 43*a* of the thermal head 43 have a length P/N in the paper feed direction. Therefore downsizing of the thermal head can be realized. If the required thickness of the ink on the recording paper is $d_2$ as shown in FIG. 5, the thickness $d_1$ of the ink layer will be $d_1=N \times d_2$.

EMBODIMENT 10

Figure 7:
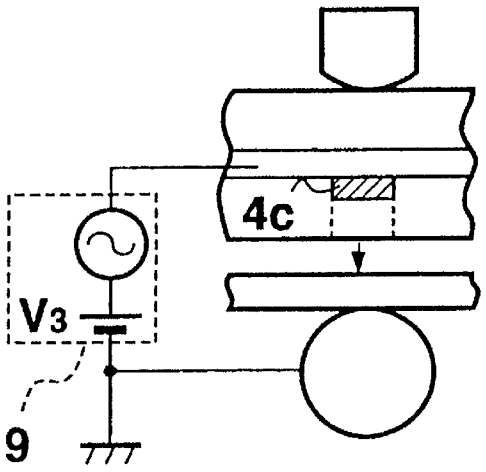
FIGS. 7(A), 7(B) and 7(C) are diagrams of another modified thermal recording apparatus according to a still further embodiment, illustrating how an ink sheet is used repeatedly by controlling a bias voltage.
Figure 7:
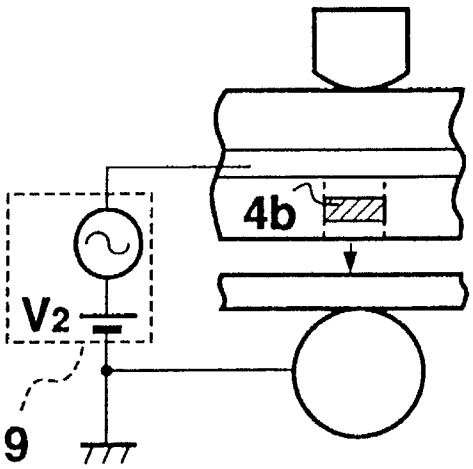
Figure 7:
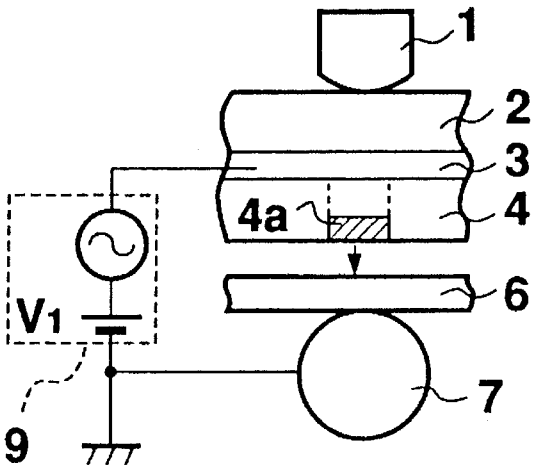

FIGS. 7(A), 7(B), 7(C), 8(A) and 8(B) show a tenth embodiment. Parts or elements similar to those of FIG. 1 are designated by like reference numerals and their description is omitted for clarity. None of the foregoing embodiments mention anything about the number of times of use of the ink sheet. Also in almost all of the conventional apparatuses, the ink sheet is used once. Only a small number of apparatuses use the ink sheet repeatedly. As the number of times of use increases, printing difference and hence unevenness occurs between the faded portions where printing was previously made and the unfaded portions. This deteriorates the quality of recording. In this embodiment, for the first time use, as shown in FIG. 7(A), a bias voltage $V_1$ is impressed to cause the ink of the conductive ink layer 4 at a portion 4*a* nearest to the recording paper 6 to fly and adhere to the paper. When being used for the the second time, a bias voltage $V_2$ is impressed as shown in FIG. 7(B). $v_2$ is a product of increasing $V_1$ by a predetermined voltage $\Delta V$. This increment causes the ink of the conductive ink layer 4 at a deeper portion 4*b* to fly and adhere to the paper. Also, when being used for the third time, the bias voltage is further increased by $\Delta V$ to cause the ink of the conductive ink layer 4 at an even more deeper portion 4*c* to fly and adhere to the paper. In this example, the ink sheet was used three times. Alternatively the ink sheet may be used more times. It is necessary to set an increment $\Delta$ of the bias voltage for such additional use.

Figure 8:
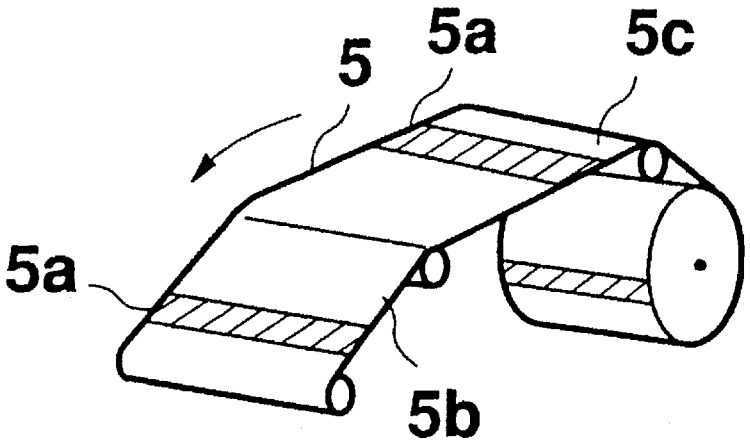
FIGS. 8(A) and 8(B) are diagrams each showing an ink sheet in which the frequency of use can be recorded when the ink sheet is used repeatedly.
Figure 8:
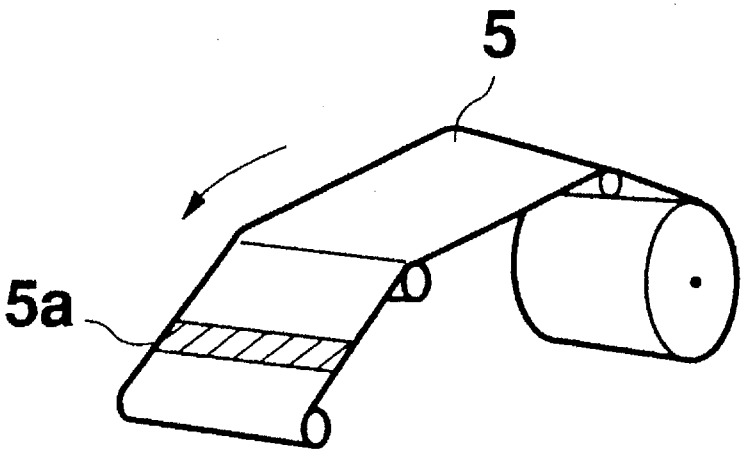

In this embodiment, in order to ascertain the number of times the ink sheet has been used, the ink sheet 5 has a recording portion 5*a* where the number of times of use is to be recorded (FIGS. 8(A) and 8(B)). The recording portion 5*a* includes a magnetic recording medium, and the thermal recording apparatus is also equipped with a non-illustrated read head for reading the number of times of use recorded in the recording portion 5*a* and a non-illustrated write head for writing the number times of use in the recording portion 5*a*. FIG. 8(A) shows the case in which the ink sheet 5 has at its leading end portion the recording portion 5*a*. In this case, the ink sheet 5 is wound up all the way to one side and is then wound back, and for reuse, the number of times it has been used recorded in the recording portion 5*a* is read out and the readout number of times of use plus one is stored in the recording portion 5*a*. The ink sheet 5 of FIG. 8(B) has a plurality of recording portions 5*a* at regular distances. In this case, the ink sheet portion 5*b* between the first recording portion and the second recording portion is used a predetermined number of times (three times in this embodiment). Also during that time, each time it is used, the number of times use is read out from the recording portion 5*a* and then the readout number plus one is stored in the recording portion 5*a*. When the number of times of use in the portion 5*b* between two adjacent recording portions reaches three, the ink sheet 5 is fed further and then recording is made in the portion 5*c*.

In this embodiment, the recording portion 5*a* is constituted by a magnetic recording portion. This invention should by no means be limited to this specific example. For example, each time it is used, a small hole may be formed in the ink sheet at a predetermined position from which the number of uses is to be discriminated, or the number of times of use may be stored in a built-in recording portion of the apparatus rather than the recording portion of the ink sheet. This built-in recording portion can be previously stored in, for example, an $E^2$ PROM.

EMBODIMENT 11

According to this invention, as described above, an electric field is created between the ink sheet 5 and the recording paper 6 to cause ink particles to fly toward the recording paper 6. According to the intensity of this electric field, the amount of ink caused to fly is controlled in order to control the recording density. However, if the distance between the recording paper 6 and the ink sheet 5, particularly the conductive ink layer 4, was not kept constant, the amount of ink caused to fly and adhere to the recording paper would vary so that a stable recording density could not be achieved.

With this point in mind, according to this embodiment, there is provided a gap retaining means for retaining the distance between the conductive ink layer 4 and the recording paper 6. This embodiment will now be described with reference to FIG. 9. Parts or elements similar to those of FIGS. 1(A), 1(B) are designated by like reference numerals and their description is omitted for clarity.

Figure 9:
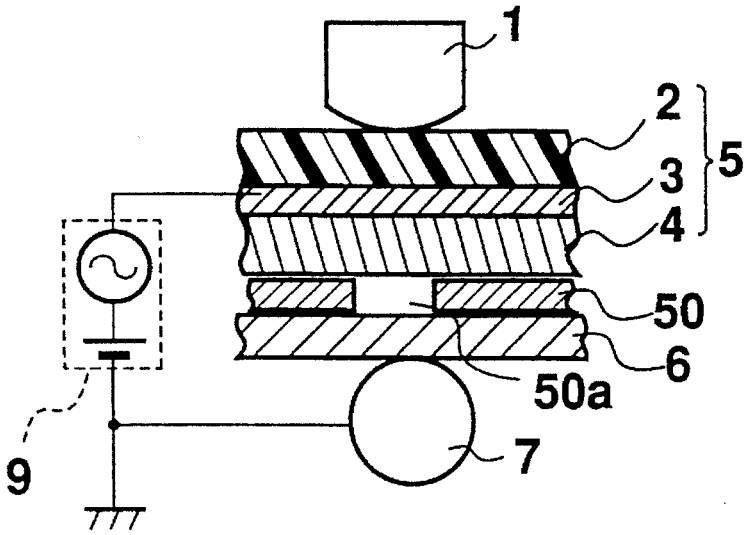
FIG. 9 is a diagram showing a gap retaining means for keeping the distance between an ink layer of the ink sheet and a recording sheet constant.

In FIG. 9, a gap retainer 50 is inserted between the ink sheet 5 and the recording paper 6. The gap retainer 50 is fixed with respect to the thermal head 1 and has an opening 50*a* normally in confronting relation to the thermal head 1. The thickness of the gap retainer 50 is the distance between the conductive ink layer 4 and the recording paper 6. Through the opening 50*a*, the ink particles fly and adhere to the recording paper 6. With this gap retainer 50, it is possible to retain a constant distance.

EMBODIMENT 12

Figure 10:
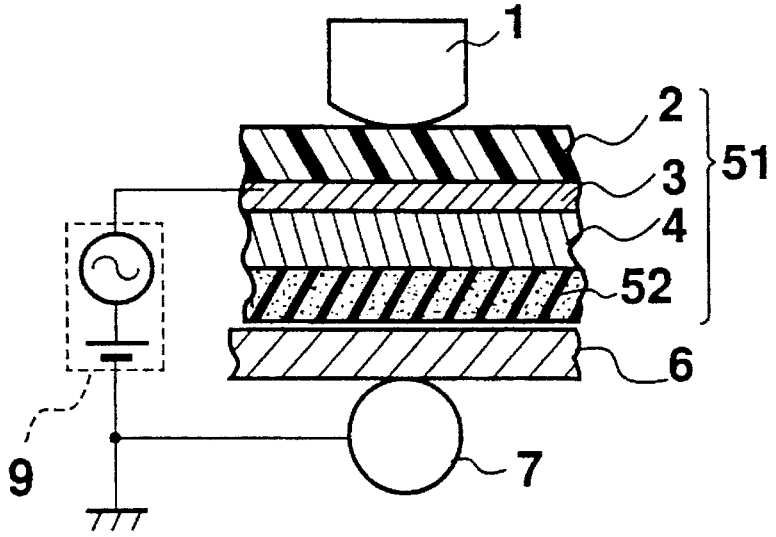
FIG. 10 is a diagram showing a modified form of gap retaining means.

This is another embodiment regarding means for retaining the distance between the conductive ink layer 4 and the recording paper 6. FIG. 10 shows an example in which the ink sheet has a mesh layer 52 at a side toward the recording paper 6. Thus the ink sheet 51 is a four-layer structure comprising the PET film 2, the metal layer 3, the conductive ink layer 4 and the mesh layer 52. With this mesh layer 52, the gap between the conductive ink layer 4 and the recording paper 6 is kept constant. The mesh size of the mesh layer 52 must be larger than the ink particle size.

According to Embodiments 11 and 12, the distance between the conductive ink layer 4 and the recording paper 6 can be kept constant so that a stable recording density can be obtained. Particularly in half-tone recording, it is possible to realize a half-tone repeatability with high precision.

EMBODIMENT 13

Figure 11:
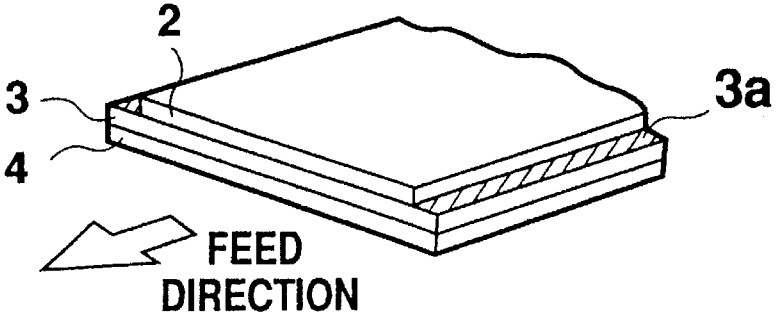
FIGS. 11(A), 11(B) and 11(C) are diagrams each showing a contact portion of the ink sheet from which potential is applied to the ink sheet.
Figure 11:
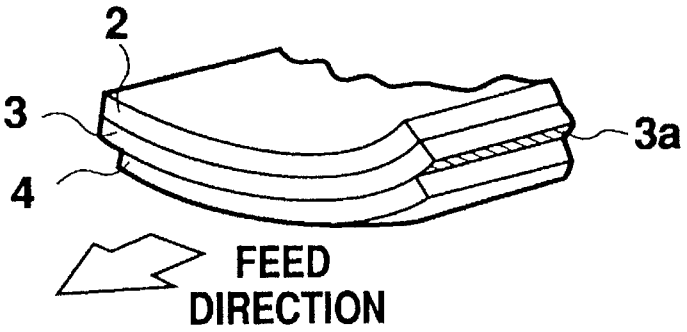
Figure 11:
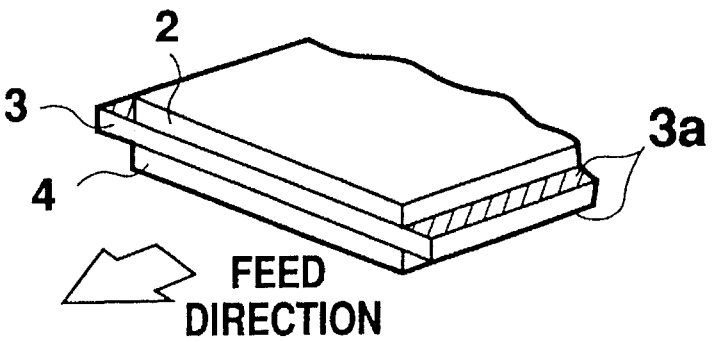

This embodiment relates to how a potential is applied to the metal layer of the ink sheet. As shown in FIGS. 11(A), 11(B) and 11(C), the width of the metal layer 3 is larger than that of at least one of the PET film 2 and the conductive ink layer 4. Specifically, in FIG. 11(A), it is larger than the PET film 2 and is contactable at a contact portion 3*a* with the electrode. In FIG. 11(B), in which the one end of the metal layer 3 is lifted to show the contact portion 3*a* contactable with the electrode, it is larger than the conductive ink layer. In FIG. 11(C), in which a potential can be supplied from either the PET film 2 or the conductive ink layer 4, it is longer than both the PET film 2 and the conductive layer 4.

Figure 12:
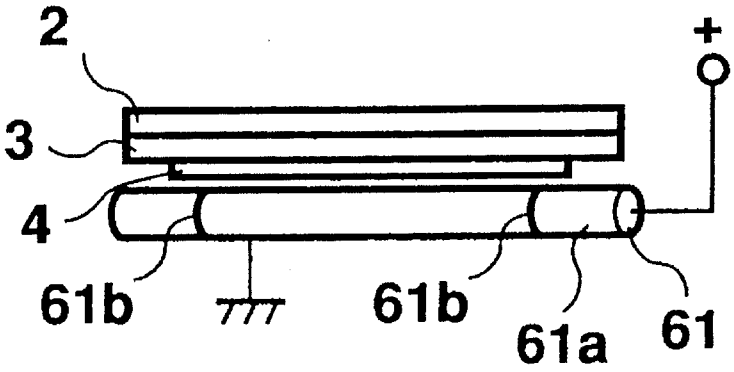
FIGS. 12(A) and 12(B) are diagrams showing an electrode for applying a potential to the ink sheet.
Figure 12:
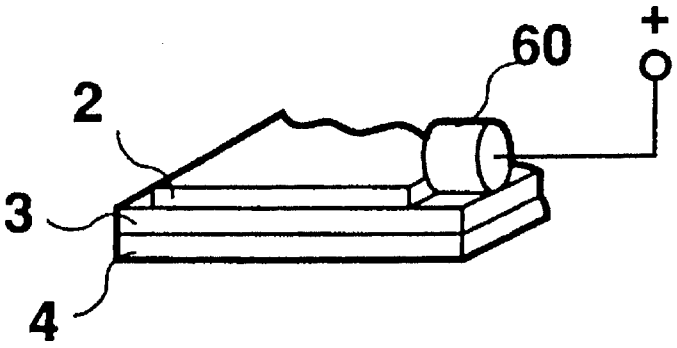
Figure 13:
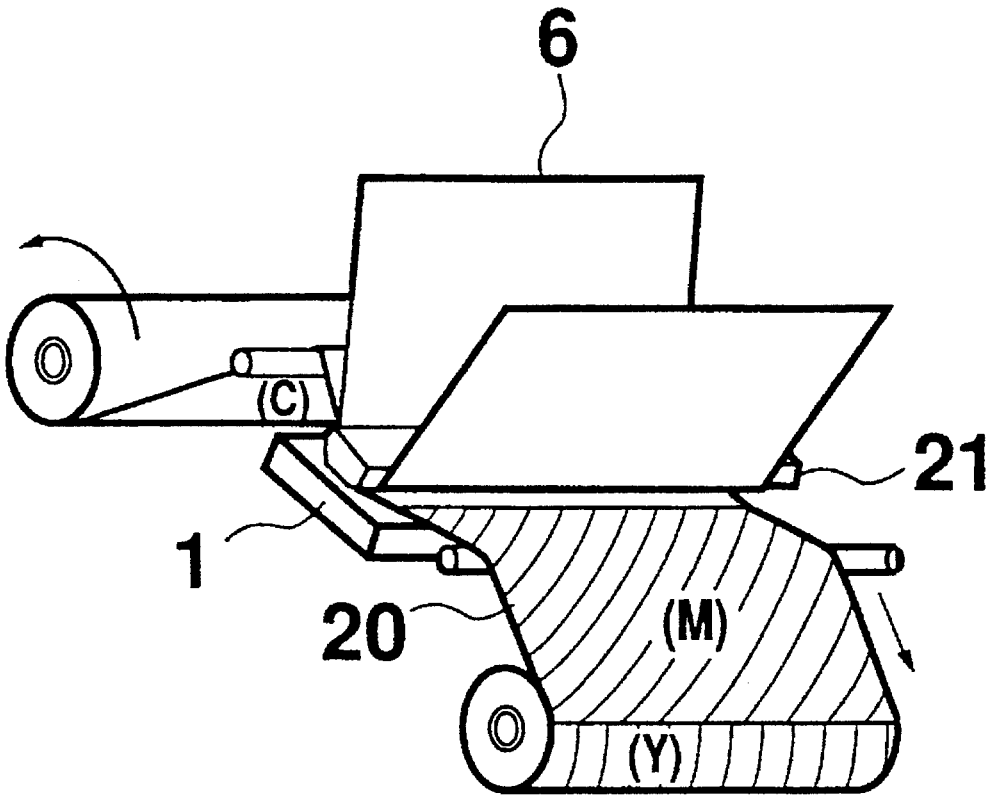
Fig. 13 PRIOR ART
FIG. 13 is a perspective view showing the main portion of a conventional thermal transfer recording apparatus.

FIGS. 12(A) and 12(B) each show an electrode for applying a potential to the ink sheet. As shown in FIG. 11(A), if the electrode needs to contact the electrode from the upper side, an electrode 60 is provided, through which a potential is applied. As shown in FIG. 11(B), if the electrode needs to contact the electrode from the lower side, the platen roller surface has a conductive portion 61*a* facing the contact portion 3*a*, through which a potential is applied. Since the platen roller must be grounded at a surface portion facing the ink sheet 5, the surface portion is insulated from the conductive portion 61*a* by an insulator 61*b*.

The portion from which the potential is applied may be an ink sheet feed roller or a reel at the ink sheet other than the platen roller 7. In this case, the feedwise length of the metal layer 3 is longer than at least one of the PET film 2 and the conductive ink layer 4. Considering the possible danger to the operator or noise to the thermal head 1, the potential to be applied to the reel at the end of the ink sheet is preferably 0 V. Further, the metal layer 3 may be exposed between ink coated surfaces, and a voltage may be impressed by a roller between the thermal head 1 and an ink sheet supply or take-up roller (not shown). In either case, the area of the metal layer 3 (conductive layer) is preferably larger than that of the conductive ink layer 4 or the PET film 2.

Also in the case where the ink layer is conductive, the ink layer is larger in width than the PET film so that a potential can be impressed in the same manner as this embodiment.

In each of the foregoing embodiments, the conductive ink layer 4 is conductive. Alternatively the conductive ink layer 4 may be chargeable; that is, if there is a chargeability to a degree such that the melted ink particles can move by overcoming the coulomb force between the ink particles, the same result can be achieved.

Further, by using, as the binder of the ink material, a resin material whose resistance value decreases when heated, it is possible to cause a current to flow only when heated by the thermal head so that any accidental leak and discharge are prevented.

Further, in the illustrated embodiment, the ink sheet is pressed against the recording paper by the platen roller. However, this contact is not absolutely necessary, and it is possible to cause ink to adhere to the recording paper due to only gravity and the electric field. In this embodiment, the platen roller is composed of metal and rubber. Alternatively the platen roller may be formed of only metal or a conductive substance. In addition, in this embodiment, the ink sheet 5 includes a metal layer 3. The metal layer 3 should by no means be limited to metal, and may be made of any other conductive substance. If the conductive ink layer is highly conductive, the metal layer 3 may be omitted.

As described above, according to the thermal recording apparatus of this invention, since it comprises an ink sheet having a conductive or chargeable ink layer, a thermal head for heating the ink sheet, and an electric field impressing means for applying an electric field between the ink sheet and the recording medium, the ink which is softened by the heat of the thermal head flies and adheres to the recording medium under the influence electric field created by the electric impressing means, thus causing high-quality recording, free of voids.

In the case where an electric field to be impressed is obtained by superimposing an a.c. voltage over a d.c. voltage, since due to the electric field of the a.c. voltage the vibrated ink particles fly to reach the recording medium, the unevenness of the recording density can be averaged, thus causing improved quality recording and good half-tone recording.

By making the ink sheet feed speed slower than the recording paper feed speed, it is possible to reduce the consumption of the ink sheet and to reduce the size of the thermal head.

By providing a gap retaining means for keeping the distance between the ink layer and the recording paper constant, it is possible to control the printing density with more stableness and more particularly it is possible to control the half-tone recording with high precision.

What is claimed is:

1. A thermal recording apparatus, comprising:

an ink sheet having layers including a conductive layer and one of a conductive ink layer and a chargeable ink layer, the one of a conductive ink layer and a chargeable ink layer having ink particles, wherein said conductive layer has an area larger than remaining layers of said ink sheet, the area being defined as a coupling area;

a thermal head for heating said ink sheet; and means for generating an electric field between said ink sheet and a recording medium to cause at least some of the ink particles to fly from the ink sheet to the recording medium, the means for generating applying an electric potential to the coupling area to generate the electric field.

2. A thermal recording apparatus, comprising:

an ink sheet having layers including a resistance layer for generating joule heat when energized, a conductive layer, and one of a conductive ink layer and a chargeable ink layer, the one of a conductive ink layer and a chargeable ink layer having ink particles, wherein said conductive layer has an area larger than remaining layers of said ink sheet, the area being defined as a coupling area;

a pair of electrodes for applying a current to said resistance layer to heat said resistance layer, heat from said resistance layer heating the one of a conductive ink layer and a chargeable ink layer; and means for generating an electric field between said ink sheet and a recording medium to cause at least some of the ink particles to fly from the ink sheet to the recording medium, the means for generating applying an electric potential to the coupling area to generate the electric field.

3. A thermal recording apparatus, comprising:

an ink sheet having layers including a photo-thermal transducing layer for generating heat upon receipt of an electromagnetic wave, a conductive layer, and one of a conductive ink layer and a chargeable ink layer, the one of a conductive ink layer and a chargeable ink layer having ink particles, wherein said conductive layer has an area larger than remaining layers of said ink sheet, the area being defined as a coupling area;

means for applying an electromagnetic wave to said photo-thermal transducing layer to heat said photo-thermal transducing layer, heat from said photo-thermal transducer layer heating the one of a conductive link layer and a chargeable ink layer; and means for generating an electric field between said ink sheet and a recording medium to cause at least some of the ink particles to fly from the ink sheet to the recording medium, the means for generating applying an electric potential to the coupling area to generate the electric field.

4. The thermal recording apparatus according to claim 1, 2 or 3, wherein said means for generating includes means for generating an a.c. field superimposed over a d.c. field.

5. The thermal recording apparatus according to claim 1, 2 or 3, further comprising a means for conveying the ink sheet and a means for conveying the recording medium wherein said ink sheet is conveyed at a rate of 1/N of a conveyance rate of said recording medium and in a same direction of conveyance.

6. The thermal recording apparatus according to claim 1, wherein said thermal head includes a heat generator, the thermal recording apparatus further comprising a means for conveying the ink sheet and a means for conveying the recording medium wherein said ink sheet is conveyed at a rate of 1/N of a conveyance rate of said recording medium and wherein the heat generator of said thermal head has a width P perpendicular to a direction of conveyance of the recording medium and has a length, in the direction of conveyance of the recording medium, which is 1/N of the width P.

7. The thermal recording apparatus according to claim 1, 2 or 3, wherein said ink sheet is able to be used repeatedly by increasing the electric field produced by the means for generating with increasing frequency of use.

8. The thermal recording apparatus according to claim 1, 2 or 3, wherein an ink material permeated in said ink sheet is a binder to which a conductive material is added.

9. The thermal recording apparatus according to claim 1, 2 or 3, wherein said ink sheet comprises an ink material of an inorganic pigment obtained from a white conductive pigment by dyeing.

10. The thermal recording apparatus according to claim 1, 2 or 3, wherein said chargeable ink layer of said ink sheet is formed of an ink holding material which is insulative at room temperature and conductive when heated.

11. The thermal recording apparatus according to claim 1, 2 or 3, further comprising means for retaining a gap between said ink sheet and said recording medium.

12. The thermal recording apparatus according to claim 7, wherein the ink sheet can be used a number of times, the thermal recording apparatus further comprising means for writing a use signal on said ink sheet so as to record the number of times said ink sheet is used and further including a means for reading said use signal and wherein said means for generating is responsive to the means for reading.

13. The thermal recording apparatus according to claim 11, further including a thermal head for heating said ink sheet, wherein the means for retaining a gap comprises a fixed retainer in confronting relation to said thermal head and wherein said means for retaining a gap has a passage to allow the ink particles to pass therethrough.

14. The thermal recording apparatus according to claim 11, wherein the means for retaining a gap comprises a mesh layer connected to said ink sheet, said mesh layer having a mesh size larger than said ink particles so as to allow said at least some of the ink particles to pass therethrough.

15. The thermal recording apparatus of claim 1 wherein the conductive layer has a first portion having a first width across a planar surface facing the thermal head, the one of a conductive ink layer and a chargeable ink layer having a second width, the first width being wider than the second width, the first portion of the conductive layer being the coupling area.

16. The thermal recording apparatus of claim 2, further comprising a thermal head for heating said ink sheet, wherein the conductive layer has a first portion having a first width across a planar surface facing the thermal head, the one of a conductive ink layer and a chargeable ink layer having a second width, the first width being wider than the second width, the first portion of the conductive layer being the coupling area.

17. The thermal recording apparatus of claim 3, further including a thermal head for heating said ink sheet, wherein the conductive layer has a first portion having a first width across a planar surface facing the thermal head, the one of a conductive ink layer and a chargeable ink layer having a second width, the first width being wider than the second width, the first portion of the conductive layer being the coupling area.

18. A thermal recording apparatus, comprising:

an ink sheet having layers including one of a conductive ink layer and a chargeable ink layer;

a thermal head for heating said ink sheet; and means for generating an electric field between said ink sheet and a recording medium, said electric field having an A.C. field superimposed over a D.C. field.

19. A thermal recording apparatus, comprising:

an ink sheet having layers including a resistance layer for generating joule heat when energized and one of a conductive ink layer and a chargeable ink layer;

a pair of electrodes for applying a current to said resistance layer to heat said resistance layer, heat from said resistance layer heating the one of a conductive ink layer and a chargeable ink layer; and means for generating an electric field between said ink sheet and a recording medium, said electric field having an A.C. field superimposed over a D.C. field.

20. A thermal recording apparatus comprising:

an ink sheet having layers including a photo-thermal transducing layer for generating heat upon receipt of an electromagnetic wave and one of a conductive ink layer and a chargeable ink layer;

means for applying an electromagnetic wave to said photo-thermal transducing layer to heat said photo-transducing layer, heat from said photo-transducing layer heating the one of a conductive ink layer and a chargeable ink layer; and means for generating an electric field between said ink sheet and a recording medium, said electric field having an A.C. field superimposed over a D.C. field.

21. The thermal recording apparatus according to claims 18, 19 or 20, wherein said ink sheet is able to be used repeatedly by increasing the electric field produced by the means for generating with increasing frequency of use.

22. The thermal recording apparatus according to claims 18, 19 or 20, wherein an ink material permeated in said ink sheet is a binder to which a conductive material is added.

23. The thermal recording apparatus according to claims 18, 19, or 20, wherein said ink sheet comprises an ink material of an inorganic pigment obtained from a white conductive pigment by dyeing.

24. The thermal recording apparatus according to claims 18, 19, or 20, wherein said chargeable ink layer of said ink sheet is formed of an ink holding material which is insulative at room temperature and conductive when heated.

25. The thermal recording apparatus according to claims 18, 19, or 20, further comprising means for retaining a gap between said ink sheet and said recording medium.

26. The thermal recording apparatus according to one of claims 18, 19, or 20, wherein the means for generating includes a D.C. voltage generator and an A.C. voltage generator connected in series, the D.C. voltage generator and the A.C. voltage generator being coupled between the recording medium and the ink sheet.

27. The thermal recording apparatus according to one of claims 18, 19, or 20, wherein the means for generating includes means for generating a nonzero D.C. bias voltage and an A.C. voltage added to the nonzero D.C. bias voltage.

28. The thermal recording apparatus according to one of claims 18, 19, or 20, wherein the one of a conductive ink layer and a chargeable ink layer of the ink sheet includes ink particles of varying size, and wherein the means for generating includes means for causing the ink particles of varying size to arrive at the recording medium at substantially the same time.

29. A thermal recording apparatus comprising:

an ink sheet having layers including a conductive layer and one of a conductive ink layer and a chargeable ink layer, the one of a conductive ink layer and a chargeable ink layer having ink particles;

a thermal head for heating said ink sheet:

means for generating an electric field between said ink sheet and a recording medium to cause at least some of the ink particles to fly from the ink sheet to the recording medium, the means for generating including means for applying an electric potential to the conductive layer of the ink sheet to generate the electric field; and means for conveying the ink sheet and a means for conveying the recording medium wherein said ink sheet is conveyed at a rate of 1/N of a conveyance rate of said recording medium and in a same direction of conveyance, wherein said thermal head includes a heat generator having a width P perpendicular to a direction of conveyance of the recording medium and has a length, in the direction of conveyance of the recording medium, which is substantially equal to 1/N of the width P.

* * * * *